US009591876B2

(12) United States Patent
Alima

(10) Patent No.: US 9,591,876 B2
(45) Date of Patent: Mar. 14, 2017

(54) ELECTRIC VAPORIZER HEATING ASSEMBLY WITH DUAL ANODIZED HEATING COMPARTMENTS

(71) Applicant: Yariv Alima, Plantation, FL (US)

(72) Inventor: Yariv Alima, Plantation, FL (US)

(73) Assignee: Atmos Nation LLC, Davie, FL (US)

( * ) Notice: Subject to any disclaimer, the term of this patent is extended or adjusted under 35 U.S.C. 154(b) by 636 days.

(21) Appl. No.: 14/101,810

(22) Filed: Dec. 10, 2013

(65) Prior Publication Data

US 2014/0314397 A1 Oct. 23, 2014

Related U.S. Application Data

(60) Provisional application No. 61/814,913, filed on Apr. 23, 2013.

(51) Int. Cl.
*A24F 47/00* (2006.01)

(52) U.S. Cl.
CPC ..... *A24F 47/008* (2013.01)

(58) Field of Classification Search
CPC ..... A24F 47/008; H05B 3/03
USPC ..... 219/520, 521, 541, 533; 392/386, 387, 392/390; 128/200.14, 202.21; 131/194
See application file for complete search history.

(56) References Cited

U.S. PATENT DOCUMENTS

| | | | | |
|---|---|---|---|---|
| 5,144,962 | A * | 9/1992 | Counts | A24F 47/008 128/200.14 |
| 5,666,978 | A * | 9/1997 | Counts | A24F 47/008 131/194 |
| 7,458,374 | B2 * | 12/2008 | Hale | A24F 47/006 128/203.26 |
| 7,726,320 | B2 * | 6/2010 | Robinson | A24F 47/008 131/194 |
| 8,733,345 | B2 * | 5/2014 | Siller | A24F 47/006 128/202.21 |
| 9,259,035 | B2 * | 2/2016 | Terry | A24F 47/008 |
| 2014/0060528 | A1 * | 3/2014 | Liu | A24F 47/002 128/202.21 |

* cited by examiner

*Primary Examiner* — David Angwin
*Assistant Examiner* — Amit K Singh

(57) ABSTRACT

An electric vaporizer heating chamber that provides a user with two options for heating various smoke forming substances has a first heating compartment and a second heating compartment. The first heating compartment and second heating compartment are enclosed by a chamber casing and are positioned in between a lower heat insulator and an upper heat insulator. The first heating compartment is supported by a heater seat which also insulates the chamber casing. A heating coil is positioned within the first heating compartment and allows substances placed in the first heating compartment to be combusted. The second heating compartment can be placed within the first heating compartment overtop of the heating coil in order to vaporize substances placed in the second heating compartment. A battery connector is also housed within the chamber casing and provides electrical connections for supplying current to the heating coil in order to heat the heating coil.

10 Claims, 7 Drawing Sheets

ELECTRIC VAPORIZER HEATING ASSEMBLY WITH DUAL ANODIZED HEATING COMPARTMENTS

The current application claims a priority to the U.S. Provisional Patent application Ser. No. 61/814,913 filed on Apr. 23, 2013.

FIELD OF THE INVENTION

The present invention relates generally to an apparatus for smoking. More specifically, the present invention is a heating apparatus for electric vaporizers that provides users with multiple options for heating herbs.

BACKGROUND OF THE INVENTION

Smoking is a widely practiced route of administration that involves the combustion of herbs in order to release active substances found in said herbs. The product of the combustion is then inhaled and absorbed through the lungs. Although many methods and mechanisms of smoking herbs currently exist, by far the most common is the cigarette. Cigarettes generally comprise a quantity of tobacco that is packed tightly into a cylindrical sealed rolling paper. One end of the cigarette is lit in order to combust the tobacco and release nicotine from the tobacco leaves. While tobacco cigarettes are most commonly smoked this way, many other loose herbs may be packed and rolled for consumption by smoking. Despite the prevalence of smoking, many health hazards and risks have become associated with the practice of consuming herbs by smoking. Modern medical studies have successfully linked a plethora of medical problems to smoking including many cancers, heart attacks/diseases, emphysema, infertility, and birth defects, among others. Many of these medical problems are caused by the toxic and carcinogenic products that are found in smoke. Several alternatives to rolling papers exist for smoking including pipes, hookahs, and bongs. However, the vast majority of these alternative methods of smoking still involve the combustion of herbs resulting in toxic and carcinogenic smoke. Vaporization is an alternative to burning that is generally regarded as a safer alternative, as a vaporizer extracts active ingredients form herbs without releasing the many toxins and carcinogens found in smoke. Although produced vapor still contains trace amounts of tar and noxious gases, the overall method is seen as a safer alternative to the full combustion of herbs. Despite the apparent lowered risk of vapor inhalation relative to smoke inhalation, a common practice is to alternate between the various methods of consuming herbs, often simply as a result of convenience. The present invention seeks to enhance and improve upon currently existing methods and accessories for consuming herbs.

The present invention is an improved and versatile heating chamber for electric vaporizers. The heating chamber comprises two independent hard anodized heating compartments. The hard anodized coating prevents heat damage to the heating compartments while facilitating cleaning. This is particularly important as the heating compartments are situated in direct contact with a heating element used to heat herbs. The hard anodized coating allows the heating compartments to retain heat to sufficiently heat herbs without damaging the compartments. A heating coil is positioned within a first heating compartment, along the bottom surface of the first heating compartment. A second heating compartment is nested within the first heating compartment such that the bottom surface of the second heating compartment comes into contact with the heat coil located within the first heating compartment. This arrangement of the two heating compartments provides users with two primary configurations for consuming herbs placed within the compartments. Herbs placed into the first compartment come into direct contact with the heating coil. As a result, the herbs are combusted and smoke containing active substances is released for consumption. In this first configuration, the second heating compartment is not needed and may be removed from the heating apparatus. Alternatively, in the second configuration, herbs are placed into the second heating compartment and the compartment is nested within the first heating compartment. The bottom surface of the second heating compartment is conductively heated by the heating coil and the herbs release vaporized active substances for consumption. In both the first configuration and the second configuration, the produced smoke or vapor is then routed through the vaporizer for inhalation by a user.

DETAIL DESCRIPTIONS OF THE INVENTION

All illustrations of the drawings are for the purpose of describing selected versions of the present invention and are not intended to limit the scope of the present invention.

Figure 1:
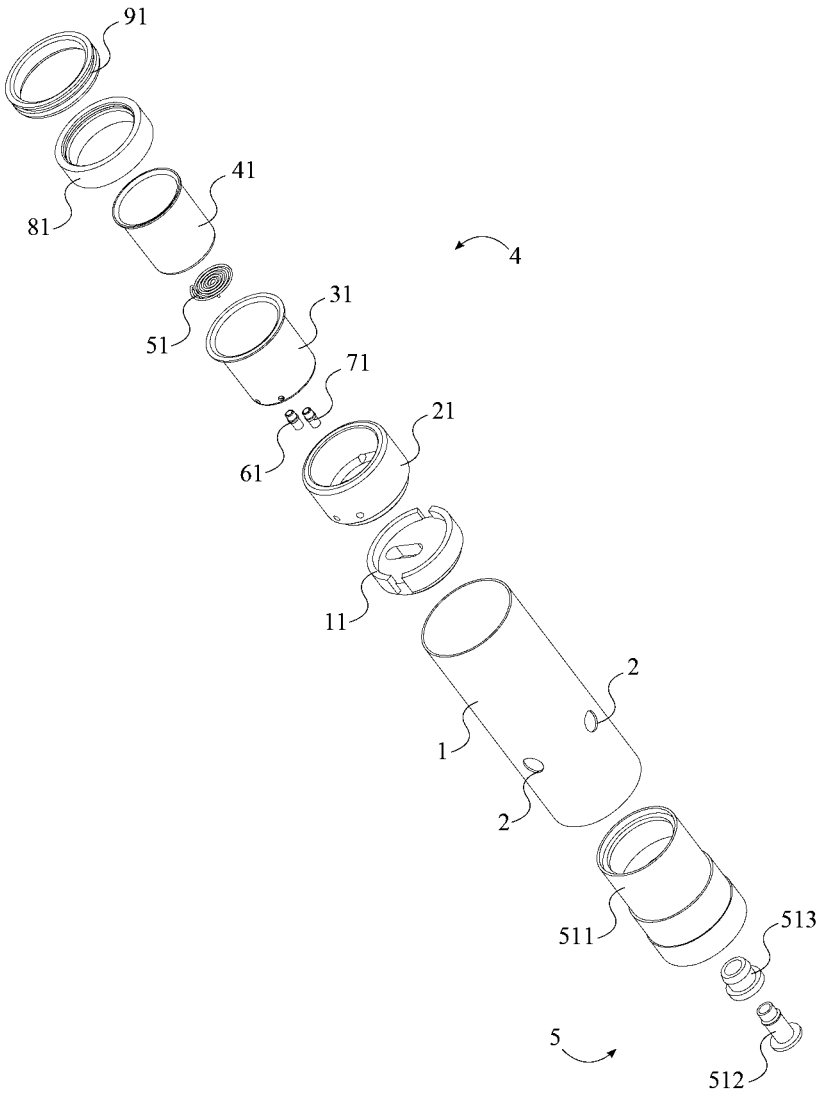
FIG. 1 is an exploded view of the present invention.

The present invention is an electric vaporizer heating chamber that provides a user with two options for heating herbs or other various smoke forming substances. The electric vaporizer heating chamber allows a user to combust herbs to release active substances in smoke form but also provides the option to conductively heat the herbs and release the active substances in vapor form. In its preferred embodiment, the present invention comprises a chamber casing 1, a plurality of ventilation holes 2, a perimeter gap 3, a heating assembly 4, a battery connector 5, and a connector insert 91,as shown in FIG. 1; the chamber casing 1, the perimeter gap 3, and the battery connector 5 being concentrically aligned with each other. The heating assembly 4 and the battery connector 5 are enclosed within the chamber casing 1.

Figure 2:
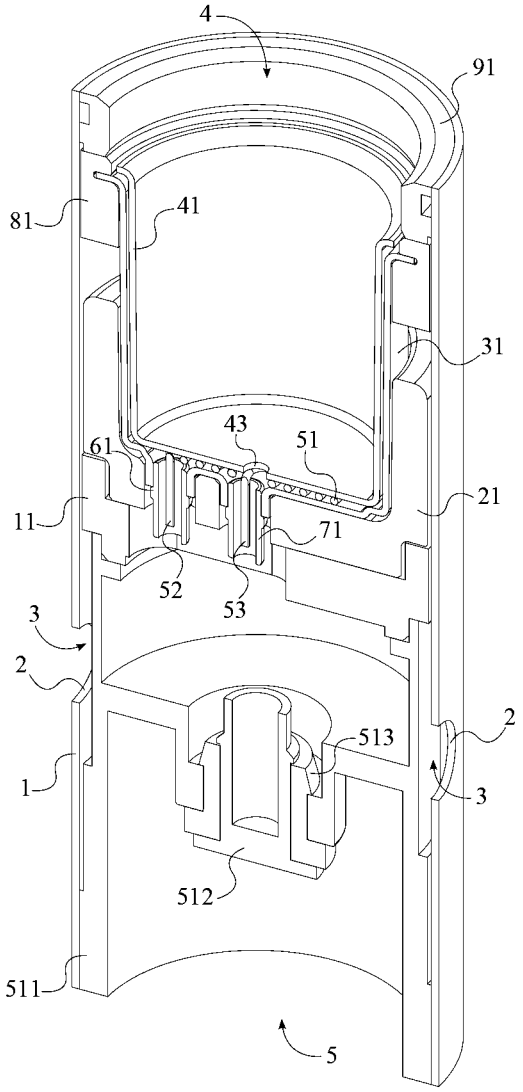
FIG. 2 is a perspective sectional view of the present invention.
Figure 3:
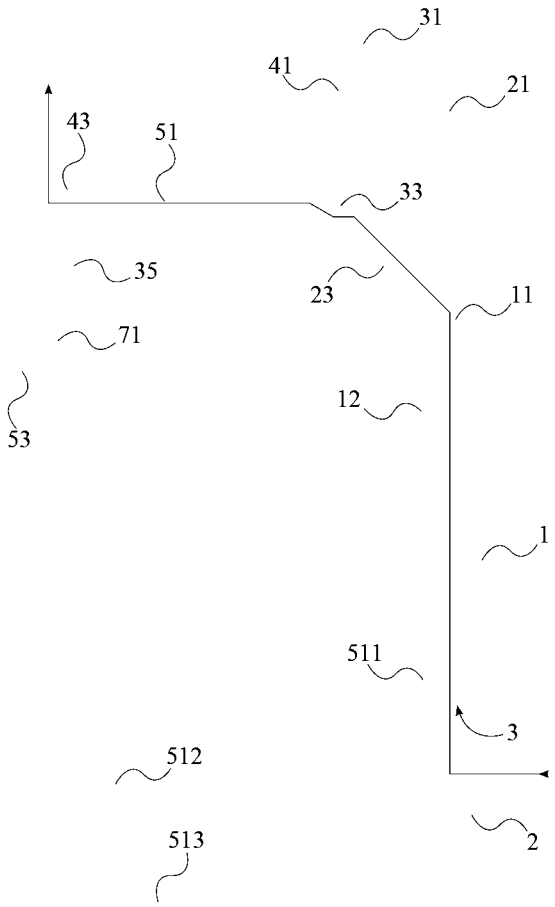
FIG. 3 is a front sectional view of the present invention showing the flow of air from the plurality of ventilation holes to the second heating compartment.

In reference to FIG. 2-3, the chamber casing 1 is the housing structure that encompasses both the heating assembly 4 and the battery connector 5. In the preferred embodiment of the present invention, the chamber casing 1 is a cylindrical sleeve that encases the heating assembly 4 and the battery connector 5; however, it is possible for the chamber casing 1 to be any shaped sleeve. The perimeter gap 3 is positioned in between the chamber casing 1 and the battery connector 5. The perimeter gap 3 provides an empty volume of space between the chamber casing 1 and the battery connector 5 through which air may flow in order to allow for the combustion of herbs by the heating assembly 4. The plurality of ventilation holes 2 laterally traverses through the chamber casing 1 and are positioned around the chamber casing 1 adjacent to the perimeter gap 3. The heating assembly 4 is in fluid communication with the plurality of ventilation holes 2 through the perimeter gap 3. In this way, air is pulled through the plurality of ventilation holes 2, through the perimeter gap 3, and through the heating assembly 4 in order to allow herbs to be combusted or otherwise heated.

In further reference to FIG. 1, the battery connector 5 allows the electric vaporizer heating chamber to be connected to an electric power source, such as a battery, in order to provide electrical current for powering the heating assembly 4. The battery connector 5 comprises a battery pin 512, a battery pin connector 513, and a battery connector casing 511. The battery connector casing 511 provides a housing structure for the battery pin 512 and battery pin connector 513, as well as a means of connection between the electric vaporizer heating chamber and the power source. In one embodiment of the present invention, the battery connector casing 511 has a lower female threaded portion for being coupled to a male threaded portion of the power source. In another embodiment of the present invention, the battery connector casing 511 provides a means for frictionally securing the power source to the battery connector casing 511. In addition to the means of connection described above, the battery connector casing 511 may be attached to the power source in any other suitable manner.

In reference to FIG. 2, the battery pin 512 and the battery pin connector 513 are concentrically positioned within the battery connector casing 511. The battery pin connector 513 is a hollow cylindrical member with an inner circumference sized to receive the battery pin 512. The battery pin connector 513 is connected to the battery connector casing 511, while the battery pin 512 is positioned through and connected to the battery pin connector 513. In addition to retaining the battery pin 512 in place within the battery connector casing 511, the battery pin connector 513 electrically insulates the battery pin 512.

The battery pin 512 is a cylindrical member having a flat circular plate on the bottom end. The battery pin 512 comprises a positive contact and a negative contact. The positive contact is positioned on the bottom surface of the flat circular plate, while the negative contact is positioned around the lateral surface of the flat circular plate. The battery pin 512 is not limited to this specific configuration of the positive contact and negative contact, as the positions of the positive contact and negative contact can be switched or changed altogether (e.g. both the positive contact and negative contact can be positioned on the bottom of the flat circular plate with separation between the two). The positive contact and negative contact of the battery pin 512 engage similar contacts on the attached power source, which in turn forms an electrical circuit between the electric vaporizer heating chamber and the power source.

The heating assembly 4 is positioned within the chamber casing 1, adjacent to the battery connector 5. The heating assembly 4 resides above the battery connector 5 and allows herbs and other combustible substances to be heated in order to produce a smoke or vapor that can in turn be inhaled by the user. Current is provided from the power source to the heating assembly 4 through the battery connector 5. In reference to FIG. 1, the heating assembly 4 comprises a lower heat insulator 11, a heater seat 21, a heating coil 51, a first heater connector 61, a second heater connector 71, an upper heat insulator 81, a first heating compartment 31, and a second heating compartment 41.

The lower heat insulator 11 is concentrically positioned within the chamber casing 1, adjacent to the battery connector casing 511, as shown in FIG. 2. The lower heat insulator 11 rests on top of the battery connector casing 511 and supports the heater seat 21. Additionally, the lower heat insulator 11 thermally insulates the chamber casing 1 from the combustion of substances within the first heating compartment 31 or the second heating compartment 41. This allows the user to safely handle the present invention (i.e. touch the chamber casing 1) as the electric vaporizer heating chamber is being utilized to combust substances. In the preferred embodiment of the present invention, the lower heat insulator 11 is constructed from silicon rubber; however, it is possible for the lower heat insulator 11 to be constructed from any other material(s).

Figure 4:
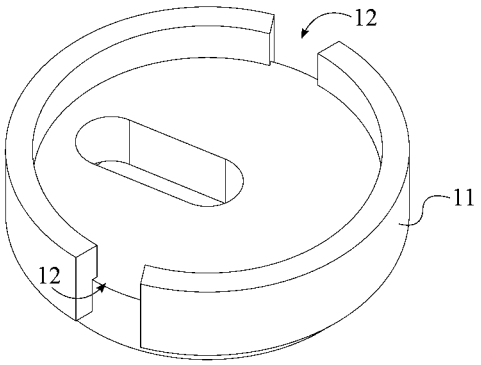
FIG. 4 is a perspective view of the lower heat insulator.

In reference to FIG. 4, the lower heat insulator 11 comprises an at least one perimeter opening 12. The at least one perimeter opening 12 is perimetrically positioned around the lower heat insulator 11 and is positioned adjacent to the perimeter gap 3. In this way, the at least one perimeter opening 12 is in fluid communication with the perimeter gap 3, thus allowing air to flow through the perimeter gap 3 to the heater seat 21. The at least one perimeter opening 12 may or may not be vertically aligned with the plurality of ventilation holes 2.

The heater seat 21 is both concentrically positioned within the chamber casing 1 and positioned adjacent to the lower heat insulator 11 opposite the battery connector 5. The lower heat insulator 11 has a shallow indented portion about the top surface into which the heater seat 21 is placed and in turn supported by the lower heat insulator 11. In the preferred embodiment of the present invention, the heater seat 21 is ceramic; however, it is possible for the heater seat 21 to be constructed using any other material(s).

Figure 5:
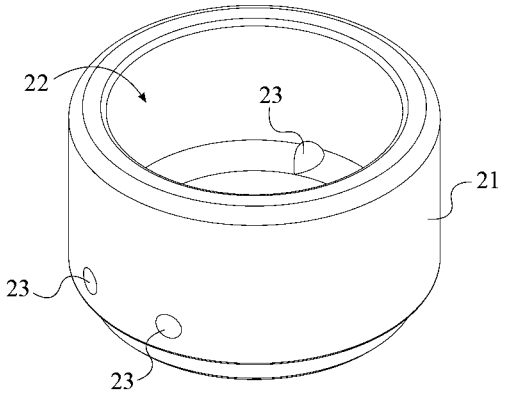
FIG. 5 is a perspective view of the heater seat.

In reference to FIG. 5, the heater seat 21 comprises a seat opening 22 and a plurality of heater seat airflow holes 23; the plurality of heater seat airflow holes 23 being positioned around the heater seat 21 opposite the seat opening 22. The seat opening 22 is oriented opposite the lower heat insulator 11, such that the first heating compartment 31 can be positioned through the seat opening 22 into the heater seat 21 opposite the lower heat insulator 11. In this way, the lower heat insulator 11 is positioned in between the first heating compartment 31 and the battery connector 5 to prevent the battery connector 5 or the power source from overheating. The plurality of heater seat airflow holes 23 is in fluid communication with the at least one perimeter opening 12, such that air traveling past the lower heat insulator 11 may pass through the heater seat 21 and into the first heating compartment 31. Similar to the lower heat insulator 11, the heater seat 21 helps to dissipate heat produced from the combustion of substances within the first heating compartment 31 or the second heating compartment 41.

The first heating compartment 31 is concentrically positioned within the chamber casing 1 and is both supported and insulated by the heater seat 21. In the preferred embodiment of the present invention, the first heating compartment 31 is constructed from steel that has been hard anodized; however, it is possible for the first heating compartment 31 to be constructed using any other material(s). Hard anodized steel is preferred in the construction of the first heating compartment 31, as it can be quickly heated and allows the first heating compartment 31 to be more readily cleaned of residue from combusted substances.

Figure 6:
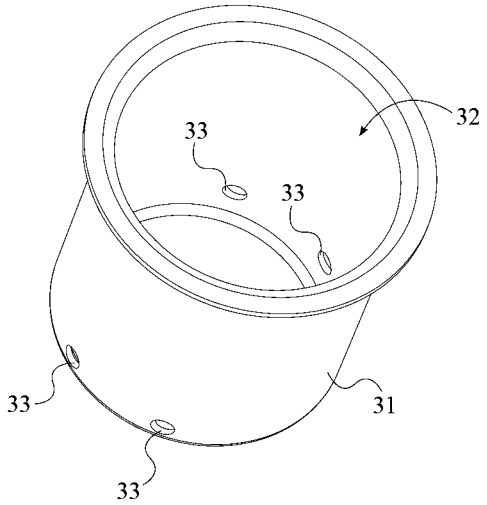
FIG. 6 is a perspective view of the hard anodized first heating compartment.

In reference to FIG. 6, the first heating compartment 31 is a cup-like fixture in which substances can be directly combusted. The first heating compartment 31 comprises a first compartment opening 32 and a plurality of heating compartment airflow holes 33; the plurality of heating compartment airflow holes 33 being positioned around the first heating compartment 31 opposite the first compartment opening 32. The first heating compartment 31 is oriented with the plurality of heating compartment airflow holes 33 being positioned within the heater seat 21. In this way, the plurality of heating compartment airflow holes 33 is in fluid communication with the plurality of heater seat airflow holes 23. Thus, air is allowed to pass through the heater seat 21 and enter the first heating compartment 31 in order to facilitate combustion of the substances placed within the first heating compartment 31.

Figure 7:
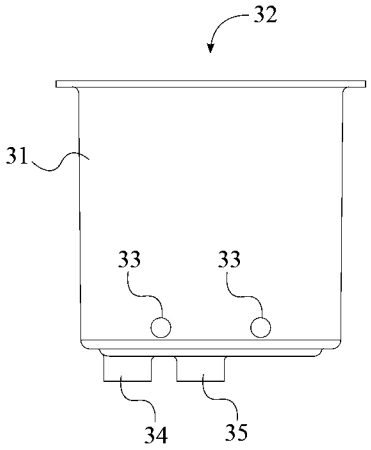
FIG. 7 is a front elevational view of the first heating compartment.

In reference to FIG. 7, the first heating compartment 31 further comprises a first heater connector port 34 and a second heater connector port 35; the first heater connector port 34 being positioned adjacent to the second heater connector port 35. The first heater connector 61 is positioned into the first heater connector port 34, while the second heater connector 71 is positioned into the second heater connector port 35. The first heater connector 61 and the second heater connector 71 are held securely in place along the bottom of the first heating compartment 31 and provide electrical connections between the heating coil 51 and the battery pin 512. Apertures traverse through both the lower heat insulator 11 and the heater seat 21 to facilitate the electrical connections between the battery pin 512 and both the first heater connector 61 and the second heater connector 71. In this way, both the first heater connector 61 and the second heater connector 71 extend below the first heating compartment 31 and traverse through the heater seat 21 and into the lower heat insulator 11 and are connected to the battery pin 512 through the battery connector casing 511.

Figure 8:
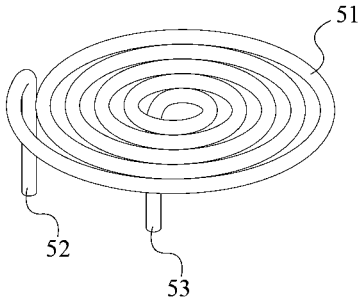
FIG. 8 is a perspective view of the heating coil.

In reference to FIG. 8, the heating coil 51 is a continuous, elongated, electrically conductive, thin piece of metal that is coiled into a planar spiral shape and positioned within the first heating compartment 31. The heating coil 51 provides a heat source for combusting substances and comprises a first terminal 52 and a second terminal 53 through which the heating coil 51 is electrically connected to the battery pin 512. The first terminal 52 and the second terminal 53 are positioned opposite each other along the heating coil 51; the first terminal 52 being electrically connected to the first heater connector 61 and the second terminal 53 being electrically connected to the second heater connector 71. The first heater connector 61 and the second heater connector 71 are also both electrically connected to the battery pin 512. In this way, current is passed through the heating coil 51, when the power source attached to the electric vaporizer heating chamber is activated. As current passes through the heating coil 51 via the first terminal 52 and the second terminal 53, the heating coil 51 acts as a resistor, producing and dissipating heat that is used to combust the substances placed within the first heating assembly 4.

Ideally, the heating coil 51 is positioned slightly above the plurality of heating compartment airflow holes 33, such that when air is pulled through the plurality of heating compartment airflow holes 33, the air passes over the heating coil 51 allowing heat to be transferred from the heating coil 51 to the air.

The second heating compartment 41 is a cup-like fixture in which materials can be indirectly heated. When the second heating compartment 41 is utilized, the second heating compartment 41 is positioned through the first compartment opening 32 into the first heating compartment 31, such that the heating coil 51 is positioned in between the first heating compartment 31 and the second heating compartment 41. In this way, materials can be indirectly heated by the heating coil 51. The heating coil 51 heats up the second heating compartment 41, which in turn heats the materials placed within the second heating compartment 41, thus allowing the materials to vaporize within the second heating compartment 41. In the preferred embodiment of the present invention, the second heating compartment 41 is constructed from steel that has been hard anodized; however, it is possible for the second heating compartment 41 to be constructed using any other material(s). Again, hard anodized steel is preferable as it can be quickly heated and allows the second heating compartment 41 to more readily be cleaned.

Figure 9:
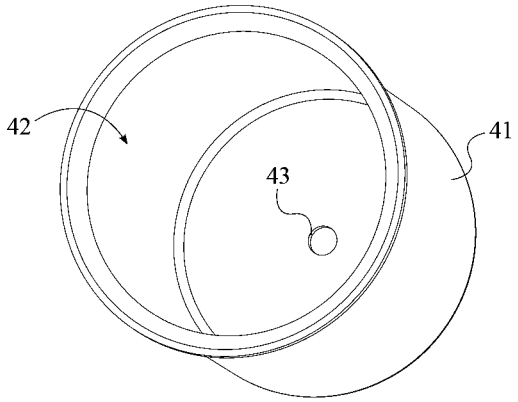
FIG. 9 is a perspective view of the hard anodized second heating compartment.
Figure 10:
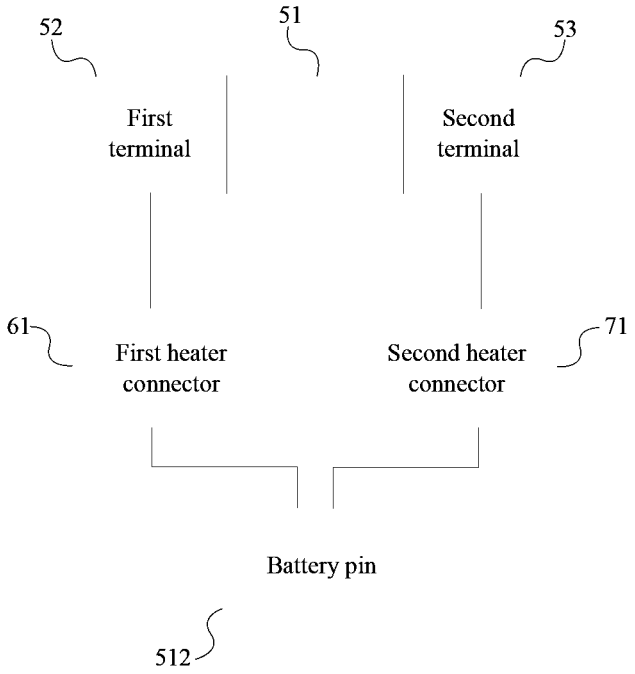
FIG. 10 is a diagram depicting the electrical connections between the heating coil, the first heater connector, the second heater connector, and the battery pin.

In reference to FIG. 9, the second heating compartment 41 comprises a second compartment opening 42 and a central airflow hole 43; the central airflow hole 43 being centrally positioned on the second heating compartment 41 opposite the second compartment opening 42. When the second heating compartment 41 is positioned into the first heating compartment 31, the central airflow hole 43 is positioned adjacent to the heating coil 51. Additionally, the central airflow hole 43 is in fluid communication with the plurality of heating compartment airflow holes 33. In this way, air can be pulled through the second heating compartment 41, allowing the user to inhale the resulting vapor the materials being vaporized within the second heating compartment 41.

In reference to FIG. 2, the upper heat insulator 81 is positioned around first compartment opening 32 of the first heating compartment 31. The upper heat insulator 81 acts to hold the first heating compartment 31 in place within the heater seat 21, as well as thermally insulate the chamber casing 1 from the heat produced by the heating coil 51. A cavity traverses around the upper heat insulator 81 through the inner surface. The outer surface of the upper heat insulator 81 frictionally engages the inner surface of the chamber casing 1, while an upper lip of the first heating compartment 31 rests within said cavity in order to securely hold the first heating compartment 31 in place. Similar to the lower heat insulator 11, in the preferred embodiment of the present invention, the upper heat insulator 81 is constructed from silicon rubber; however, it is possible for the upper heat insulator 81 to be constructed from any other material(s).

In further reference to FIG. 2, the connector insert 91 is concentrically positioned within the chamber casing 1 above the upper heat insulator 81, such that the heating assembly 4 is positioned in between the battery connector 5 and the connector insert 91. The connector insert 91 provides a means of connection between the electric vaporizer heating chamber and a mouthpiece. In one embodiment of the present invention, the connector insert 91 provides a female threaded portion that can be engaged by a male threaded portion of the mouthpiece. In another embodiment of the present invention, the connector insert 91 provides a means of frictionally holding the mouthpiece in place. In addition to the means of connection described above, it is possible for the connector insert 91 to provide any other type of connection between the chamber casing 1 and the mouthpiece.

In the preferred embodiment of the present invention, the components of the electric vaporizer heating chamber appear as shown in FIG. 2. In order to use the present invention, the desired power source and mouthpiece are attached to the electric vaporizer heating chamber. The present invention can be used in two configurations that correspond to the two options for herb consumption. In the first configuration, the second heating compartment 41 is removed and herbs are placed into the first heating compartment 31 directly in contact with the exposed heating coil 51. The plurality of heating compartment airflow holes 33 of the first heating compartment 31 is in fluid communication with the plurality of ventilation holes 2 through the perimeter gap 3, the at least one perimeter opening 12, and the plurality of heater seat airflow holes 23, as depicted in FIG. 3. This allows air to enter the first heating compartment 31 as the user inhales through the mouthpiece, which in turn allows herbs to combust under the heat of the heating coil 51. Active substances are released from the combusted herbs in smoke form and are then inhaled by the user through the mouthpiece. In the second configuration, the second heating compartment 41 is nested within the first heating compartment 31; the bottom surface of the second heating compartment 41 coming into direct contact with the exposed heating coil 51. Herbs are placed into the second heating compartment 41 and are conductively heated by the heat coil through the second heating compartment 41. The heated herbs release active substances in the form of vapor. The vapor, along with air passing through the central airflow hole 43, is then inhaled by the user through the mouthpiece.

Although the invention has been explained in relation to its preferred embodiment, it is to be understood that many other possible modifications and variations can be made without departing from the spirit and scope of the invention as hereinafter claimed.

What is claimed is:

1. An electric vaporizing chamber comprises:

a chamber casing;

a plurality of ventilation holes;

a perimeter gap;

a heating assembly;

a battery connector;

a connector insert;

the heating assembly comprises a heating coil, a first heating compartment, a lower heat insulator, an upper heat insulator, and a heater seat;

the battery connector comprises a battery pin;

the first heating compartment comprises a first compartment opening and a plurality of heating compartment airflow holes;

the lower heat insulator comprises an at least one perimeter opening;

the heater seat comprises an seat opening and a plurality of heater seat airflow holes;

the chamber casing, the perimeter gap, and the battery connector being concentrically aligned with each other;

the heating assembly being positioned adjacent to the battery connector;

the heating assembly and the battery connector being positioned within the chamber casing;

the connector insert, the first heating compartment, the lower heat insulator, the upper heat insulator, and the heater seat being concentrically positioned within the chamber casing;

the heating assembly being positioned in between the battery connector and the connector insert;

the lower heat insulator being positioned in between the battery connector casing and the first heating compartment;

the heater seat being positioned adjacent to the lower heat insulator opposite the battery connector;

the first heating compartment being positioned through the seat opening into the heater seat opposite the lower heat insulator;

the plurality of heating compartment airflow holes being positioned within the heater seat;

the upper heat insulator being positioned around the first compartment opening;

the perimeter gap being positioned in between the chamber casing and the battery connector;

the plurality of ventilation holes laterally traversing through the chamber casing;

the plurality of ventilation holes being positioned around the chamber casing adjacent to the perimeter gap;

the plurality of heating compartment airflow holes being positioned around the first heating compartment opposite the first compartment opening;

the at least one perimeter opening being positioned perimetrically around the lower heat insulator;

the plurality of heater seat airflow holes being positioned around the heater seat opposite the seat opening;

the plurality of heating compartment airflow holes being in fluid communication with the plurality of ventilation holes through the perimeter gap;

the at least one perimeter opening being in fluid communication with both the plurality of heating compartment airflow holes and the perimeter gap;

the plurality of heater seat airflow holes being in fluid communication with both the at least one perimeter opening and the plurality of heating compartment airflow holes;

the heating coil being positioned within the first heating compartment; and the heating coil being electrically connected to the battery pin.

2. The electric vaporizing chamber as claimed in claim 1 comprises:

the battery connector further comprises a battery pin connector and battery connector casing;

the battery pin and the battery pin connector being concentrically positioned within the battery connector casing;

the battery pin connector being connected to the battery connector casing; the battery pin being positioned through the battery pin connector; and the battery pin being retained by the battery pin connector.

3. The electric vaporizing chamber as claimed in claim 2 comprises:

the heating assembly further comprises a first heater connector and a second heater connector;

the first heating compartment further comprises a first heater connector port and a second heater connector port;

the first heater connector port being positioned adjacent to the second heater connector port;

the first heater connector being positioned into the first heater connector port;

the first heater connector being positioned through the heater seat and into the lower heat insulator;

the second heater connector being positioned into the second heater connector port; and the second heater connector being positioned through the heater seat and into the lower heat insulator.

4. The electric vaporizing chamber as claimed in claim 1 comprises:

the heating assembly further comprises a second heating compartment;

the second heating compartment comprises a second compartment opening and a central airflow hole;

the central airflow hole being centrally positioned on the second heating compartment opposite the second compartment opening;

the second heating compartment being positioned through the first compartment opening into the first heating compartment;

the heating coil being positioned in between the first heating compartment and the second heating compartment;

the central airflow hole being positioned adjacent to the heating coil;

and the central airflow hole being in fluid communication with the plurality of heating compartment airflow holes.

5. The electric vaporizing chamber as claimed in claim 4, wherein the second heating compartment is hard anodized.

6. The electric vaporizing chamber as claimed in claim 1 comprises:

the heating assembly further comprises a first heater connector and a second heater connector;

the heating coil comprises a first terminal and a second terminal;

the first terminal and the second terminal being positioned opposite each other along the heating coil;

the first terminal being electrically connected to the first heater connector;

the second terminal being electrically connected to the second heater connector; and the first heater connector and the second heater connector being electrically connected to the battery pin.

7. The electric vaporizing chamber as claimed in claim 1, wherein the first heating compartment is hard anodized.

8. An electric vaporizing chamber comprises: a chamber casing;

a plurality of ventilation holes;

a perimeter gap;

a heating assembly;

a battery connector;

a connector insert;

the heating assembly comprises a heating coil, a first heating compartment, a lower heat insulator, an upper heat insulator, a heater seat, a connector insert, and a first heater connector, and a second heater connector;

the battery connector comprises a battery pin;

the heating coil comprises a first terminal and a second terminal;

the first heating compartment comprises a first compartment opening, a plurality of heating compartment airflow holes, a first heater connector port, and a second heater connector port;

the lower heat insulator comprises an at least one perimeter opening;

the heater seat comprises an seat opening and a plurality of heater seat airflow holes;

the chamber casing, the perimeter gap, and the battery connector being concentrically aligned with each other;

the heating assembly being positioned adjacent to the battery connector;

the heating assembly and the battery connector being positioned within the chamber casing;

the connector insert, the first heating compartment, the lower heat insulator, the upper heat insulator, and the heater seat being concentrically positioned within the chamber casing;

the heating assembly being positioned in between the battery connector and the connector insert;

the lower heat insulator being positioned in between the battery connector casing and the first heating compartment;

the heater seat being positioned adjacent to the lower heat insulator opposite the battery connector;

the first heating compartment being positioned through the seat opening into the heater seat opposite the lower heat insulator;

the plurality of heating compartment airflow holes being positioned within the heater seat;

the upper heat insulator being positioned around the first compartment opening;

the first heater connector port being positioned adjacent to the second heater connector port;

the first heater connector being positioned into the first heater connector port;

the first heater connector being positioned through the heater seat and into the lower heat insulator;

the second heater connector being positioned into the second heater connector port;

the second heater connector being positioned through the heater seat and into the lower heat insulator;

the perimeter gap being positioned in between the chamber casing and the battery connector;

the plurality of ventilation holes laterally traversing through the chamber casing;

the plurality of ventilation holes being positioned around the chamber casing adjacent to the perimeter gap;

the plurality of heating compartment airflow holes being positioned around the first heating compartment opposite the first compartment opening;

the at least one perimeter opening being positioned perimetrically around the lower heat insulator;

the plurality of heater seat airflow holes being positioned around the heater seat opposite the seat opening;

the plurality of heating compartment airflow holes being in fluid communication with the plurality of ventilation holes through the perimeter gap;

the at least one perimeter opening being in fluid communication with both the plurality of heating compartment airflow holes and the perimeter gap;

the plurality of heater seat airflow holes being in fluid communication with both the at least one perimeter opening and the plurality of heating compartment airflow holes;

the heating coil being positioned within the first heating compartment;

the first terminal and the second terminal being positioned opposite each other along the heating coil;

the first terminal being electrically connected to the first heater connector;

the second terminal being electrically connected to the second heater connector;

the first heater connector and the second heater connector being electrically connected to the battery pin;

the heating coil being electrically connected to the battery pin; and the first heating compartment being hard anodized.

9. The electric vaporizing chamber as claimed in claim 8 comprises:

the battery connector further comprises a battery pin connector and battery connector casing;

the battery pin and the battery pin connector being concentrically positioned within the battery connector casing;

the battery pin connector being connected to the battery connector casing;

the battery pin being positioned through the battery pin connector; and the battery pin being retained by the battery pin connector.

10. The electric vaporizing chamber as claimed in claim 8 comprises:

the heating assembly further comprises a second heating compartment;

the second heating compartment comprises a second compartment opening and a central airflow hole;

the central airflow hole being centrally positioned on the second heating compartment opposite the second compartment opening;

the second heating compartment being positioned through the first compartment opening into the first heating compartment;

the heating coil being positioned in between the first heating compartment and the second heating compartment;

the central airflow hole being positioned adjacent to the heating coil;

the central airflow hole being in fluid communication with the plurality of heating compartment airflow holes; and the second heating compartment being hard anodized.

* * * * *